US007044298B1

(12) United States Patent
Pryst

(10) Patent No.: US 7,044,298 B1
(45) Date of Patent: May 16, 2006

(54) DETACHABLE GOLF CLUB SHORT CLUB BAG

(76) Inventor: Nancy L. Pryst, 11917 Skyway Ave., Oklahoma Ciy, OK (US) 73162-1046

( * ) Notice: Subject to any disclaimer, the term of this patent is extended or adjusted under 35 U.S.C. 154(b) by 110 days.

(21) Appl. No.: 10/825,996

(22) Filed: Apr. 17, 2004

(51) Int. Cl.
*A63B 55/00* (2006.01)

(52) U.S. Cl. ..... 206/315.3; 206/315.2; 206/315.6; 211/70.2

(58) Field of Classification Search ..... 206/315.2, 206/315.3, 315.6; 211/70.2
See application file for complete search history.

(56) References Cited

U.S. PATENT DOCUMENTS

| | | | | | |
|---|---|---|---|---|---|
| 2,256,521 | A | * | 9/1941 | Kirkpatrick et al. | 206/315.3 |
| 2,502,627 | A | | 4/1950 | Martin | |
| 2,595,987 | A | * | 5/1952 | Shears | 206/315.6 |
| 3,842,976 | A | | 10/1974 | Cristelli | |
| 4,911,292 | A | * | 3/1990 | Airey, Jr. | 206/315.3 |
| 5,358,109 | A | * | 10/1994 | Nichols | 206/315.3 |
| 5,472,084 | A | | 12/1995 | Aliano, Jr. | |
| 5,540,431 | A | * | 7/1996 | Crozier | 473/282 |
| 5,816,396 | A | * | 10/1998 | Shin | 206/315.3 |
| 5,918,737 | A | | 7/1999 | Kwon | |
| 6,126,050 | A | * | 10/2000 | Aliano, Jr. | 224/274 |
| 6,330,944 | B1 | * | 12/2001 | DeMichele | 206/315.3 |
| 6,352,187 | B1 | * | 3/2002 | Strode | 224/664 |
| 6,499,593 | B1 | | 12/2002 | Uner et al. | |
| 2002/0144917 | A1 | * | 10/2002 | Barrise et al. | 206/315.3 |
| 2005/0150794 | A1 | * | 7/2005 | Slankster | 206/315.3 |

FOREIGN PATENT DOCUMENTS

| | | |
|---|---|---|
| WO | WO 91/18650 | * 12/1991 |

* cited by examiner

*Primary Examiner*—Sue A. Weaver
(74) *Attorney, Agent, or Firm*—Randal D. Hamburg

(57) ABSTRACT

A detachable and collapsible auxiliary golf bag for carrying an assortment of short irons, wedges and putters, which is attached to either a larger golf bag carrying a full assortment of golf clubs or to a golf cart, is used by a golfer who wishes to transport only the short game clubs to a golf green in the event golf carts are restricted to cart paths, or where transport of the full set of clubs to the green is unwanted due to the weight of the full set of clubs. The bag carries only those clubs which might be necessary to complete the hole from the location on or near the green, and allows the golfer to select the appropriate club once the shot is determined from the position of the ball, and also allows the golfer to select other clubs without returning to the main golf bag.

2 Claims, 3 Drawing Sheets

DETACHABLE GOLF CLUB SHORT CLUB BAG

CROSS REFERENCE TO RELATED APPLICATIONS

None

I. BACKGROUND OF THE INVENTION

1. Field of Invention

A detachable and collapsible auxiliary golf bag for carrying an assortment of short irons, wedges and putters, which is attached to either a larger golf bag carrying a full assortment of golf clubs or to a golf cart, is used by a golfer who wishes to transport only the short game clubs to a golf green in the event golf carts are restricted to cart paths, or where transport of the full set of clubs to the green is unwanted due to the weight of the full set of clubs. The bag carries only those clubs which might be necessary to complete the hole from the location on or near the green, and allows the golfer to select the appropriate club once the shot is determined from the position of the ball, and also allows the golfer to select other clubs without returning to the main golf bag.

2. Description of Prior Art

The following United States patents were discovered and are disclosed within this application for utility patent. All relate to novel golf bags or secondary golf bag devices.

In U.S. Pat. No. 3,842,876 to Cristelli, a golf bag is disclosed having a shell with three compartmentalized inserts which segregate golf clubs, each insert having a frame and a cover member. U.S. Pat. No. 5,918,737 discloses a similar golf bag insert which is located within a defined cavity within a primary golf bag which may be removed from the primary golf bag with a segmented frame for the insert portion.

A piggyback golf bag which detaches from a primary golf bag having an upper and lower attaching means is disclosed in U.S. Pat. No. 5,472,084 to Aliano, Jr. However, the piggyback golf bag of Aliano is not disclosed as being collapsible with a lower cylindrical ring attached to a flexible sleeve being insertable within an upper cylindrical ring for compact storage within the primary golf bag. U.S. Pat. No. 6,499,593 to Uner also discloses some type of piggyback golf bag which attaches to the side of a primary bag adapted to accept the piggyback golf bag on a flattened side with a lower attaching means and at least one upper attaching means, having the same basic use as the present auxiliary golf club bag. However, it too cannot be collapsed to be fitted within the primary bag in a collapsed embodiment, nor is it disclosed that the Uner golf bag is adapted to attach to anything other than the primary golf bag. In fact, if the Uner golf bag had a flexible sleeve allowing the bag to collapse, it would not secure to the primary golf bag, as some rigid support is required to engage the upper and lower attaching means, the lower means disclosed as a post on a rigid plate which engages a receptacle in the carrying bag, FIG. 3, or a loop on the primary bag that engages a peg in the carrying bag, FIG. 6, or a pair of posts to receive the receptacle openings in two tandem carrying bags, FIGS. 10–11.

II. SUMMARY OF THE INVENTION

In the game of golf, most golfers carry a full set of clubs in their golf bag, including a full set of woods, irons, multiple wedges and a putter. This totals from 14 to 17 clubs. They are carried in a golf bag, which usually includes several balls, tees and other golf accessories, making the bag relatively heavy. When playing golf, many golfers use carts which have an area that accommodates and secures the golf bag in the cart for the length of play. Golfers drive their carts along the golf course, sometimes to locations on the fairway where their balls lie, but sometimes the carts are restricted to cart paths only, wherein the golfer must park his cart and carry the appropriate club to hit their ball from where it lies. In all cases, carts are restricted from the area surrounding the green, requiring golfers to walk to the green, trap or fringe and carry their clubs for further play, usually short irons, wedges and putters.

Most often is the case, a golfer cannot tell exactly what club he will use unless he is on the green. Fringe shots may require a short iron, one of several wedges or even a putter. Also often, the golfer may need more than one shot to make it in the hole, which means the golfer may carry multiple clubs. Instead of carrying the entire bag, or having a handful of loose clubs which are laid loosely on the ground, the auxiliary bag allows for the carrying of several short game clubs together to allow the golfer to carry those clubs he might use to finish the hole without carrying the whole bag of clubs, without having to detach the whole bag from the cart and without having to lay his other clubs loosely on the ground while he takes a shot with the selected club. When the clubs are placed in the bag handle down, the handles or grips are not exposed to the grass or ground moisture, keeping the club handles clean.

The primary objective of the auxiliary bag is to provide a small compact bag to carry only short clubs to and from the green to avoid carrying loose clubs and to avoid carrying the entire golf bag to the green. The secondary objective of the auxiliary bag is to make the bag detachable and collapsible. A third objective of the auxiliary bag is to provide the bag with upper and lower detachable means to attach the auxiliary bag to the primary golf bag, the golf cart, or even a belt of the golfer.

III. DESCRIPTION OF THE DRAWINGS

The following drawings are submitted with this utility patent application.

IV. DESCRIPTION OF THE PREFERRED EMBODIMENT

Figure 4:
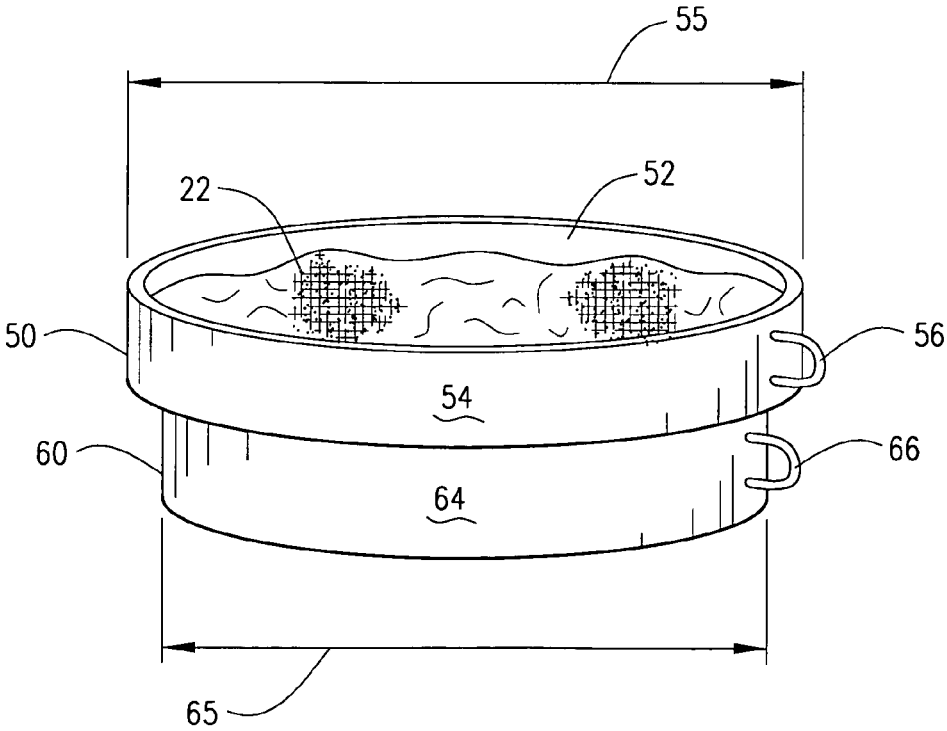
FIG. 4 is a side view of the auxiliary bag in a collapsed state.
Figure 5:
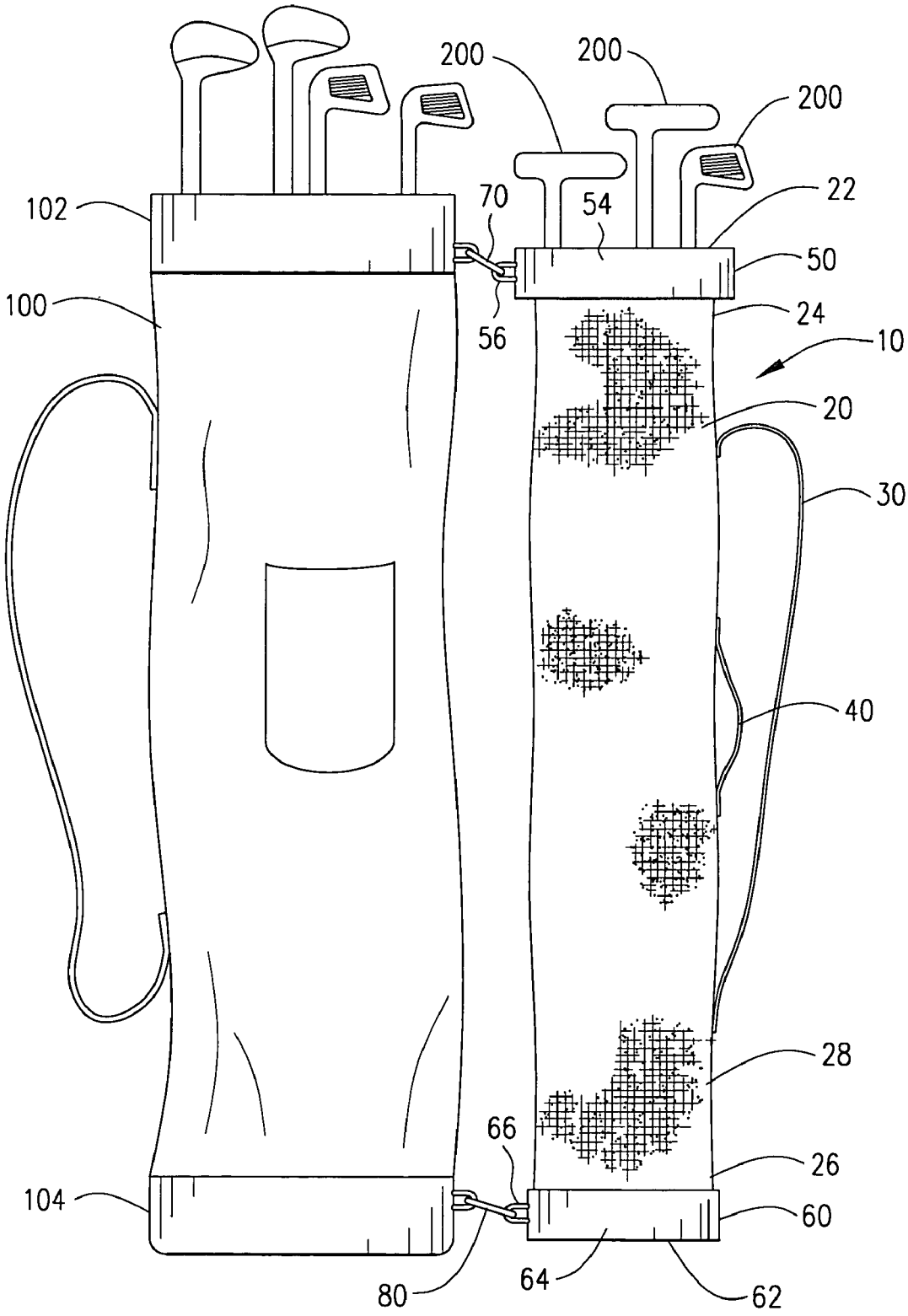
FIG. 5 is a side view of the auxiliary bag attached to a golf bag with clubs inserted in the auxiliary bag and golf bag.

A collapsible and detachable auxiliary golf club bag 10 for carrying an assortment of short play golf clubs 200, shown in FIGS. 1–5 of the drawings, attaching to a primary golf club bag, 100, golf cart or other item, comprises essentially a cylindrical flexible fabric sleeve 20 defining an inner cavity 22 adapted to contain the short play golf clubs 200, the fabric sleeve 20 having an upper end 24, a lower end 26 and an outer surface 28, a shoulder strap 30 and a hand grip strap 40 attached to the outer surface 28 of the fabric sleeve 20, a rigid upper cylindrical ring 50 attached to the upper end 24 of the fabric sleeve 20 having a central opening 52 and an outer perimeter surface 54 with a formed upper attachment hook 56 with an upper attaching means 70, a rigid lower cylindrical ring 60 attached to the lower end 26 of the fabric sleeve 20 having a lower floor segment 62 and an outer perimeter surface 64 with a formed lower attachment hook 66 with a lower attaching means 80, the upper attaching means 70 attaching to an upper portion 102 of the primary golf club bag 100 and the lower attaching means 80 attaching to a lower portion 104 of the primary golf club bag 100 when the flexible sleeve 20 is expanded, as shown in FIG. 5, the flexible sleeve 20 collapsing for storage with the lower cylindrical ring 60 fitting within the upper cylindrical ring 50 for compact storage, FIG. 4.

Figure 1:
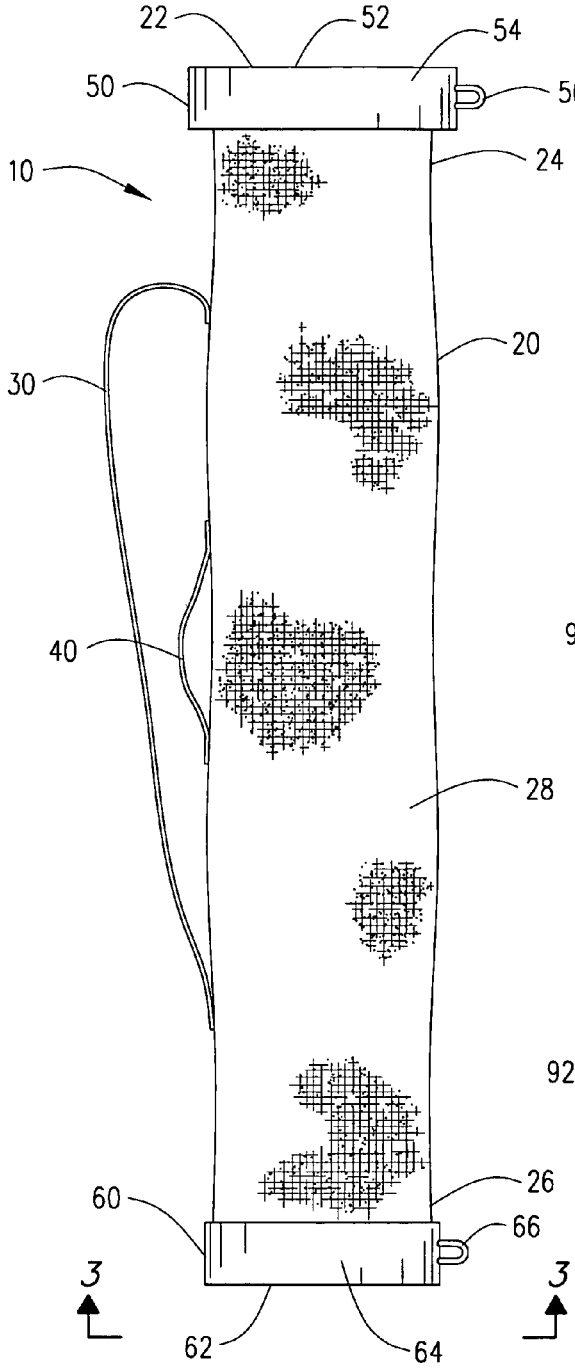
FIG. 1 is a side view of the auxiliary golf bag in an expanded state.
Figure 2A:
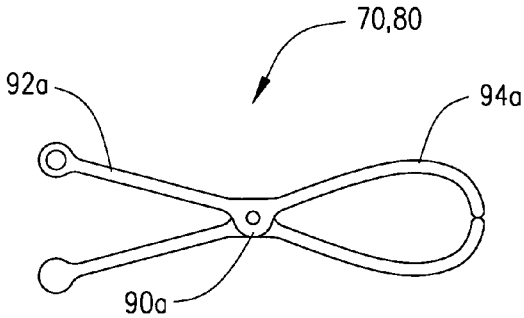
FIGS. 2A–2C are various embodiments of the upper and lower attachment means.
Figure 2B:
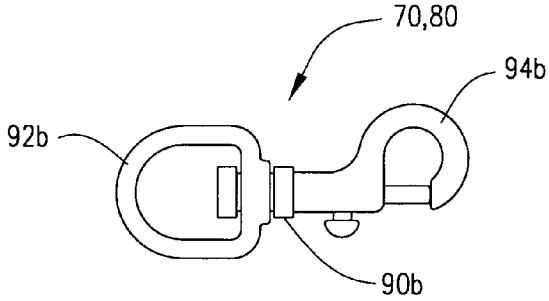
Figure 2C:
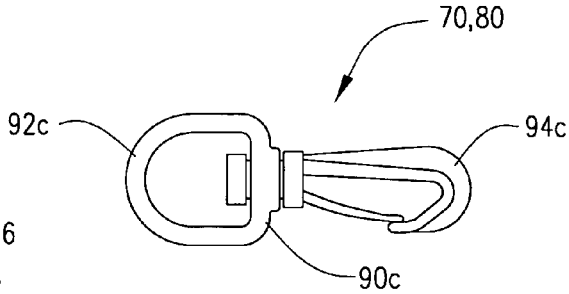
Figure 3:
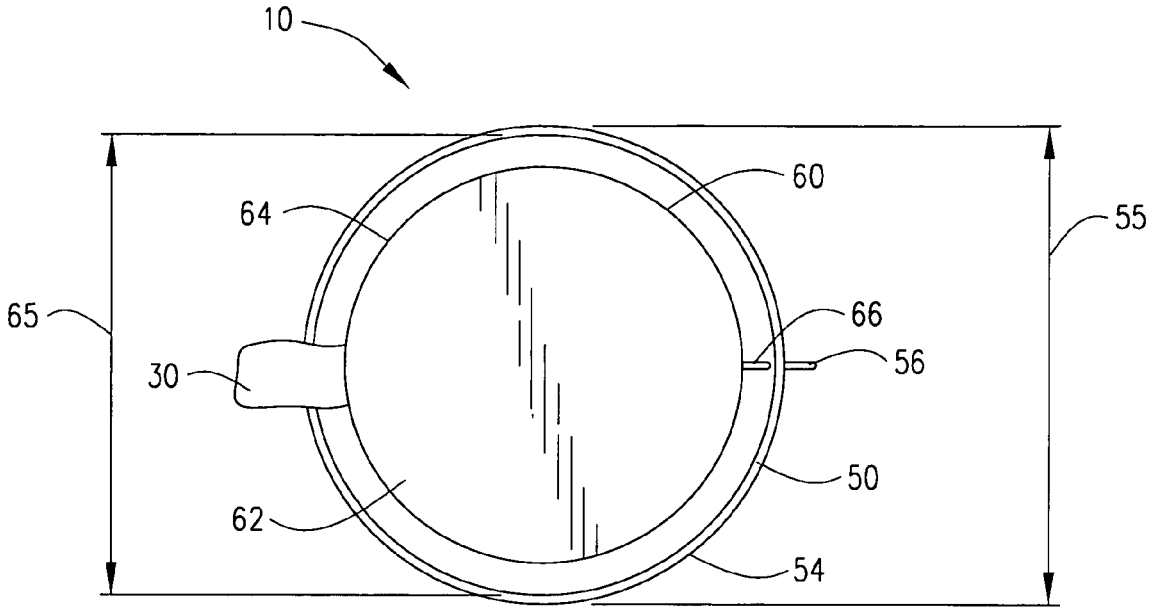
FIG. 3 is a bottom view of the auxiliary golf bag from section lines 3/3 of FIG. 1.

The upper attaching means 70 and lower attaching means 80 may be provided as a spring clip 90*a*, FIG. 2A, a spring snap hook 90*b*, FIG. 2B, or a spring hook clip 90*c*, FIG. 2C, or any other means which may be detachable using one hand. The above disclosed upper attaching means 70 and lower attaching means 80 should respectively attach to the upper attachment hook 56 and lower attachment hook 66 at a base end 92*a*, 92*b*, 92*c* and further respectively attach to the upper portion 102 and lower portion 104 of the primary golf club bag 100 at a hook end 94*a*, 94*b*, 94*c*.

The shoulder strap 30 should be a flexible fabric material as is the hand grip strap 40, the shoulder strap 30 adapted to be worn on the shoulder of a golfer and the hand grip strap 40 adapted to the hand of a golfer for carrying the auxiliary golf club bag 10 containing short play golf clubs 200.

The upper cylindrical ring 50 has a perimeter 55 larger than a perimeter 65 of the lower cylindrical ring 60, the upper cylindrical ring 50 receiving the lower cylindrical ring 60 when the auxiliary golf club bag 10 is collapsed, thereby allowing the collapsed profile of the auxiliary golf club bag 10 to be minimized for storage. The upper attaching hook 56 and lower attaching hook 66 should be aligned in a vertical axis in order to orient the auxiliary golf club bag 10 parallel with the primary golf club bag 100 when attached. The upper cylindrical ring 50 and lower cylindrical ring 60 should also be suspended in vertical alignment by the flexible sleeve 20 to allow the short play golf clubs 200 to be carried vertically within the auxiliary golf club bag 10.

The upper cylindrical ring 50 may have a plurality of dividers within the central opening 52 to separate the short play golf clubs 200 from one another, although the dividers are not shown in any drawing figures. The fabric sleeve 20 may also have pockets for carrying green markers, extra golf balls or green repair tools.

In addition to the auxiliary golf club bag 10 being attached to the primary golf club bag 100, it may be desired that the upper attachment means 70 may be attached to a rear basket of the golf cart, a golf bag securing strap on the golf cart, or even to the upper waistband or belt of the golfer, with the lower attaching means 80 not being used in these carrying fashions.

While the auxiliary golf club bag 10 has been particularly shown and described with reference to a preferred embodiment thereof, it will be understood by those skilled in the art that changes in form and detail may be made therein without departing from the spirit and scope of the auxiliary golf club bag 10.

What is claimed is:

1. A collapsible and detachable auxiliary golf club bag for carrying an assortment of short play golf clubs, the auxiliary golf club bag attaching to a primary golf club bag or golf cart, comprises essentially:

a cylindrical flexible fabric sleeve defining an inner cavity adapted to contain said short play golf clubs, said fabric sleeve having an upper end, a lower end and an outer surface, a shoulder strap and a hand grip strap attached to said outer surface of said fabric sleeve;

a rigid upper cylindrical ring attached to said upper end of said fabric sleeve having a central opening and an outer perimeter with a formed upper attachment hook attaching to an upper attaching means;

a rigid lower cylindrical ring attached to said lower end of said fabric sleeve having a lower floor segment and an outer perimeter with a formed lower attachment hook attaching to a lower attaching means, said upper attaching means attaching to an upper portion of said primary golf bag and said lower attaching means attaching to a lower portion of said primary golf bag when said flexible sleeve is expanded, said flexible sleeve collapsing for compact storage in said primary golf bag.

2. The auxiliary golf club bag, as disclosed in claim 1, further comprising:

said upper cylindrical ring has a perimeter larger than a perimeter of said lower cylindrical ring, said upper cylindrical ring receiving said lower cylindrical ring when said auxiliary bag is collapsed, thereby allowing said auxiliary golf bag to be compacted for storage;

said upper attaching hook and said lower attaching hook are aligned in a vertical axis placing said auxiliary bag parallel to said primary golf bag when attached;

said upper cylindrical ring and lower cylindrical ring are suspended in vertical alignment by said flexible sleeve to position said short game golf clubs vertically within said auxillary golf bag.

* * * * *